United States Patent [19]

Chase

[11] 4,165,579

[45] Aug. 28, 1979

[54] TOY FASHION DISPLAY MECHANISM

[76] Inventor: Herbert S. Chase, 1 Lincoln Plaza, New York, N.Y. 10803

[21] Appl. No.: 828,401

[22] Filed: Aug. 29, 1977

[51] Int. Cl.[2] ..... A63H 33/00

[52] U.S. Cl. ..... 46/13; 46/11; 46/140; 40/415; 272/31 R

[58] Field of Search ..... 46/11, 12, 13, 32, 122, 46/137, 138, 140, 116, 17; 40/106.31; 272/31 R

[56] References Cited

U.S. PATENT DOCUMENTS

| | | | |
|---|---|---|---|
| 718,721 | 1/1903 | Nelson | 272/31 R |
| 1,611,155 | 12/1926 | Bisaillon | 46/13 X |
| 2,282,430 | 5/1942 | Smith | 46/137 X |
| 2,283,104 | 5/1942 | Surman | 46/13 |
| 2,846,222 | 8/1958 | Handler | 46/13 X |
| 2,959,891 | 11/1960 | Barnett et al. | 46/116 X |
| 3,589,060 | 6/1971 | Genin | 46/122 |
| 3,672,082 | 6/1972 | Tepper et al. | 272/31 R X |
| 3,778,925 | 12/1973 | Owen | 46/13 |
| 4,030,235 | 6/1977 | Terzian et al. | 46/11 |

FOREIGN PATENT DOCUMENTS

| | | | |
|---|---|---|---|
| 1062368 | 4/1954 | France | 40/415 |

*Primary Examiner*—Russell R. Kinsey
*Assistant Examiner*—Mickey Yu
*Attorney, Agent, or Firm*—Wolder, Gross & Yavner

[57] ABSTRACT

A toy fashion display mechanism is contained within a fashionable two-compartment carrying case. In one compartment there is positioned a hand-driven turntable on an appropriate support. The turntable is constructed at its circumference to support at least one doll for display movement. A backdrop is positioned toward the rear so that the clothes on the doll may be changed while hidden from those viewing the display. The other compartment contains storage space for at least one doll and pop-up furniture to hold a selection of clothing.

6 Claims, 13 Drawing Figures

TOY FASHION DISPLAY MECHANISM

BACKGROUND OF THE INVENTION

This invention relates to toy and display mechanisms and more particularly to a device which in effect operates as a fashion show allowing the user to dress a doll in a selection of different fashions for the viewing pleasure of an audience.

Display devices are known in the art and a long history. An example of an early display device is U.S. Pat. No. 1,611,155, which basically discloses the concept of the turntable with a backdrop partially obscuring the turntable from the sight of a viewer.

An example of the use of such a display device for a toy is to be found in U.S. Pat. No. 2,283,104, in which there is shown a rotatable stage in which a figure may come to the front of the stage and then go behind a backdrop.

With the concept of toys today being towards mobility, ease of storage and ease of assembly, the abovementioned patents do not present devices which may be readily used for such purposes.

SUMMARY OF THE INVENTION

Accordingly it is among the principal objects of the present invention to provide an easily transportable and portable toy fashion display mechanism which may be readily assembled and which yet will provide sufficient and continuous enjoyment to the child user.

Still another object of the present invention is to provide a portable storage display mechanism having a display mechanism located within the portable storage means, and also having means to store a display member, and storage means to vary the selections of the displays to be carried by the display member.

Still yet a further object of the present invention is to provide a display mechanism consisting of a rotatable turntable which may be easily manufactured and which may be driven manually, and yet be durable to a high degree in use.

Still yet another object of the present invention is to provide a toy doll display mechanism of the character described, being of standard size so as to be adaptable to many of the dolls currently available under branded names on the market.

In accordance with the present invention there is provided a portable storage means, such as an overnight carrying case having at least two separate compartments in the well-known manner. In one of the compartments there may be positioned a rotatable turntable. This turntable then may be mounted on any acceptable support structure positioned within the compartment, and the turntable may have a series of gear teeth on its circumference. These gear teeth mate with a manually turned driver gear, also mounted on the support and which may be easily turned by a child. This compartment also contains receptable means to receive the legs of a backdrop which is positioned normally in a storage or flat condition within the compartment, but may be placed in the receptable means and supported as a backdrop, so that viewed from the front, the rear of the turntable is obstructed from view.

The second compartment may contain means to secure the storage of a standard fashion doll and also may contain furniture which may be pivoted to raised position when in use, the furniture containing storage facilities to house the selection of clothing fashions.

The doll may be placed on the pedestal which may be secured to the securement means of the turntable. The doll may be dressed in a fashion outfit behind the backdrop and then by turning the motor gear, the turntable is rotated, moving the doll out from behind the backdrop and before the viewers. Continued turning of the turntable will cause the doll to once again become obstructed from the viewers behind the backdrop, where the user may change the doll's clothing to have it display a different fashion selection.

BRIEF DESCRIPTION OF THE DRAWINGS

These and other objects and advantages of the present invention will become apparent from the following description taken in conjunction with the accompanying drawings.

Figure 1:
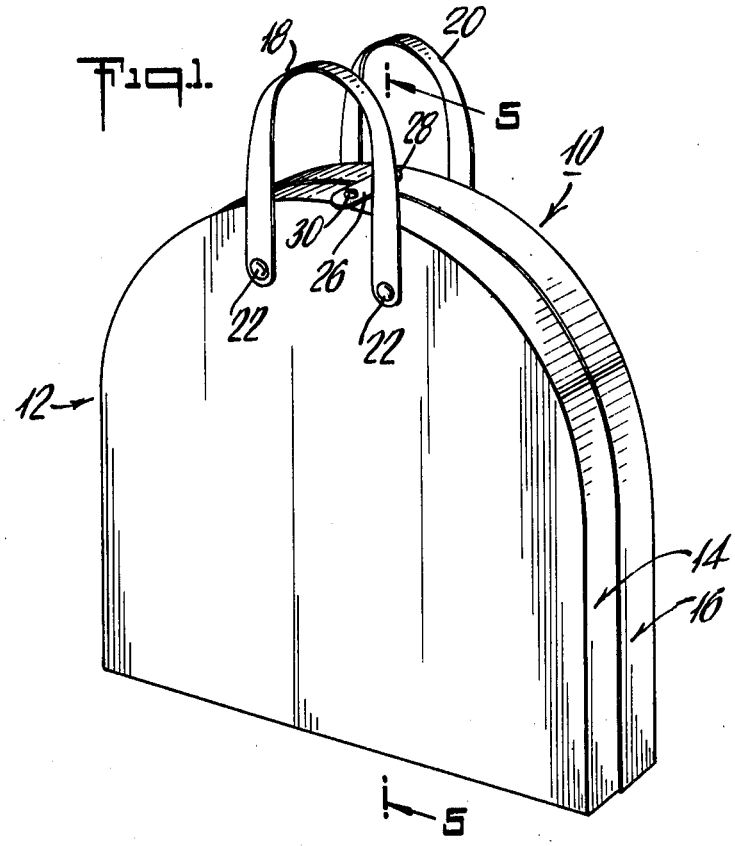
FIG. 1 is a front perspective view of the carrying case for the present invention shown in closed condition.
Figure 2:
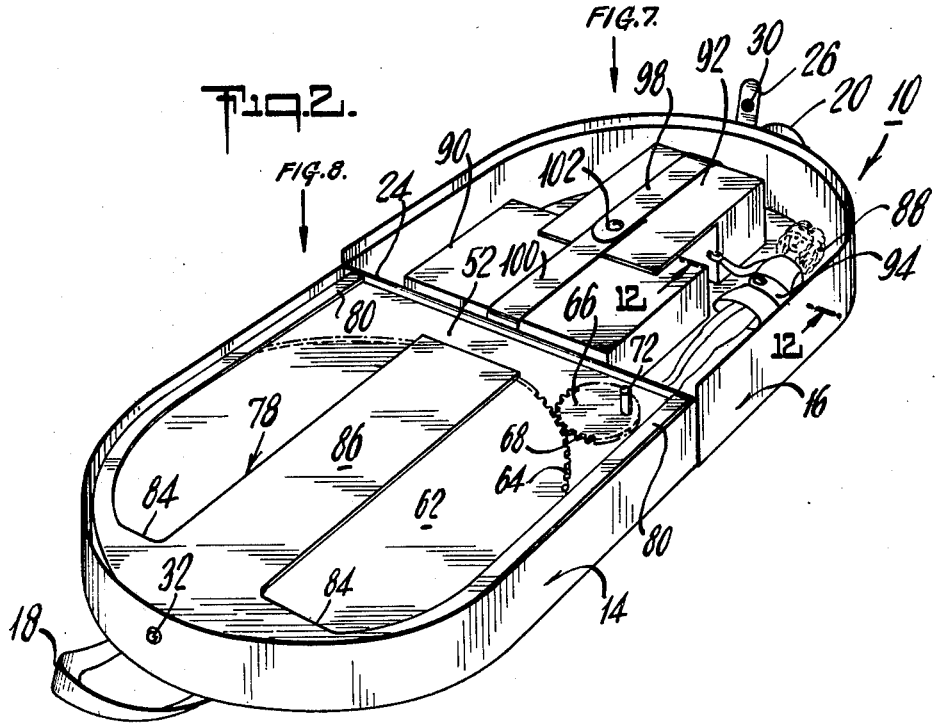
FIG. 2 is a front perspective view of the carrying case of FIG. 1 shown in open condition, with all elements still in their packed or storage condition.

Turning to the drawings, and more particularly to FIGS. 1 and 2, there is shown a toy fashion display mechanism 10 comprising a carrying case body which rises rectangularly and then ends in a rounded upper leading edge. The case may be carried by handle straps 18, 20, which may be secured by any appropriate means, such as rivets 22 in the sides of the carrying case. To insure a positive closure, the compartments which may be hinged at their bottom, as at 24, may have a closure strap consisting of a strap 26 secured by means of a rivet 28, and which carries a female fastener 30 to engage a male fastener 32 on the upper surface of compartment 14, all in the usual manner. It is clearly understood that the shape of the carrying case is incidental to the invention, and any shape with any type of handles and closures may be usable, as long as they contain sufficient interior space to close the various parts of the invention.

Figure 5:
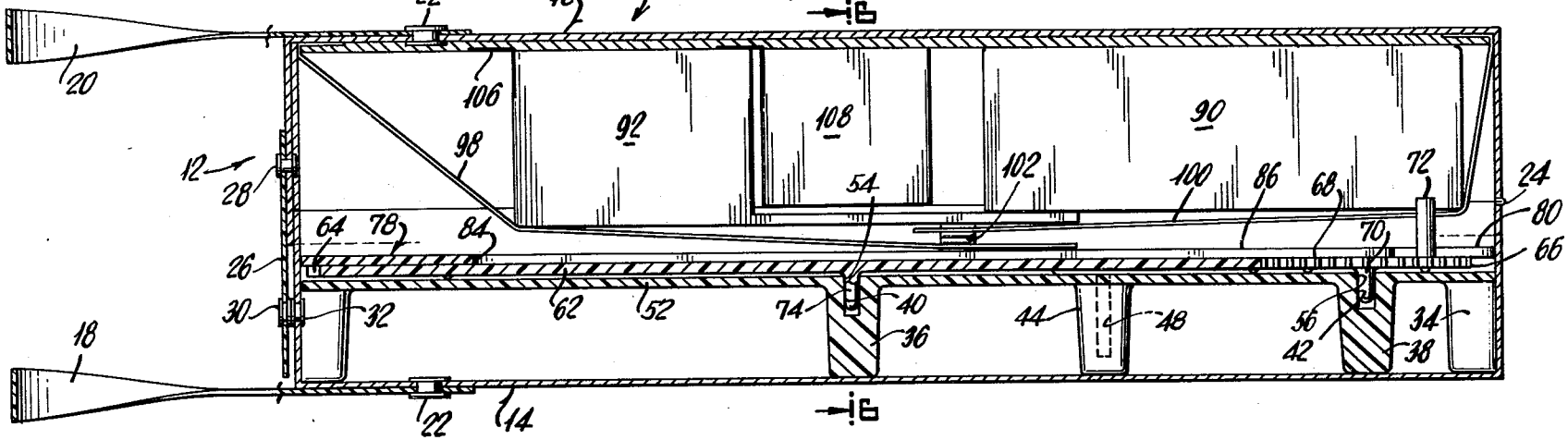
FIG. 5 is an enlarged cross-sectional view taken along lines 5—5 of FIG. 1.
Figure 6:
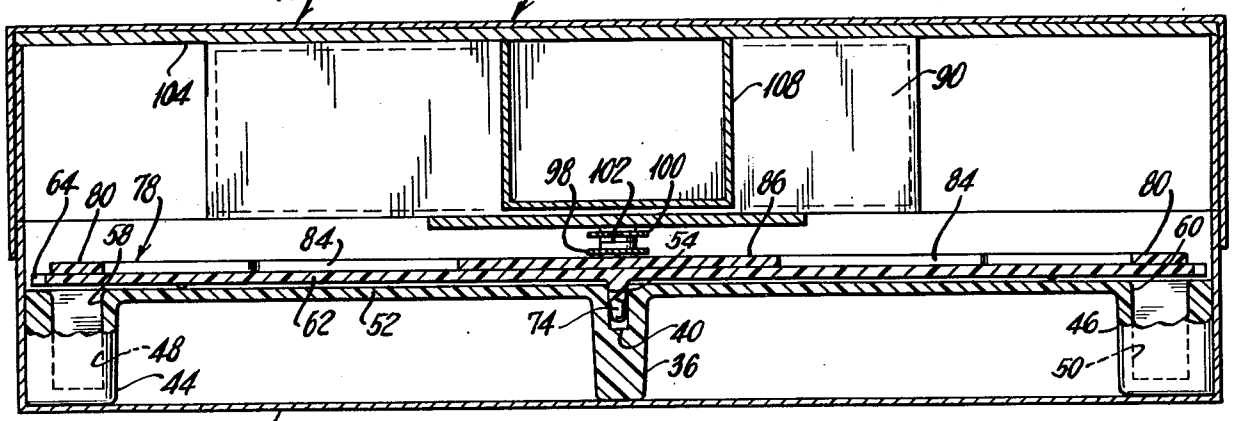
FIG. 6 is a cross-sectional view taken along lines 6—6 of FIG. 5.
Figure 7:
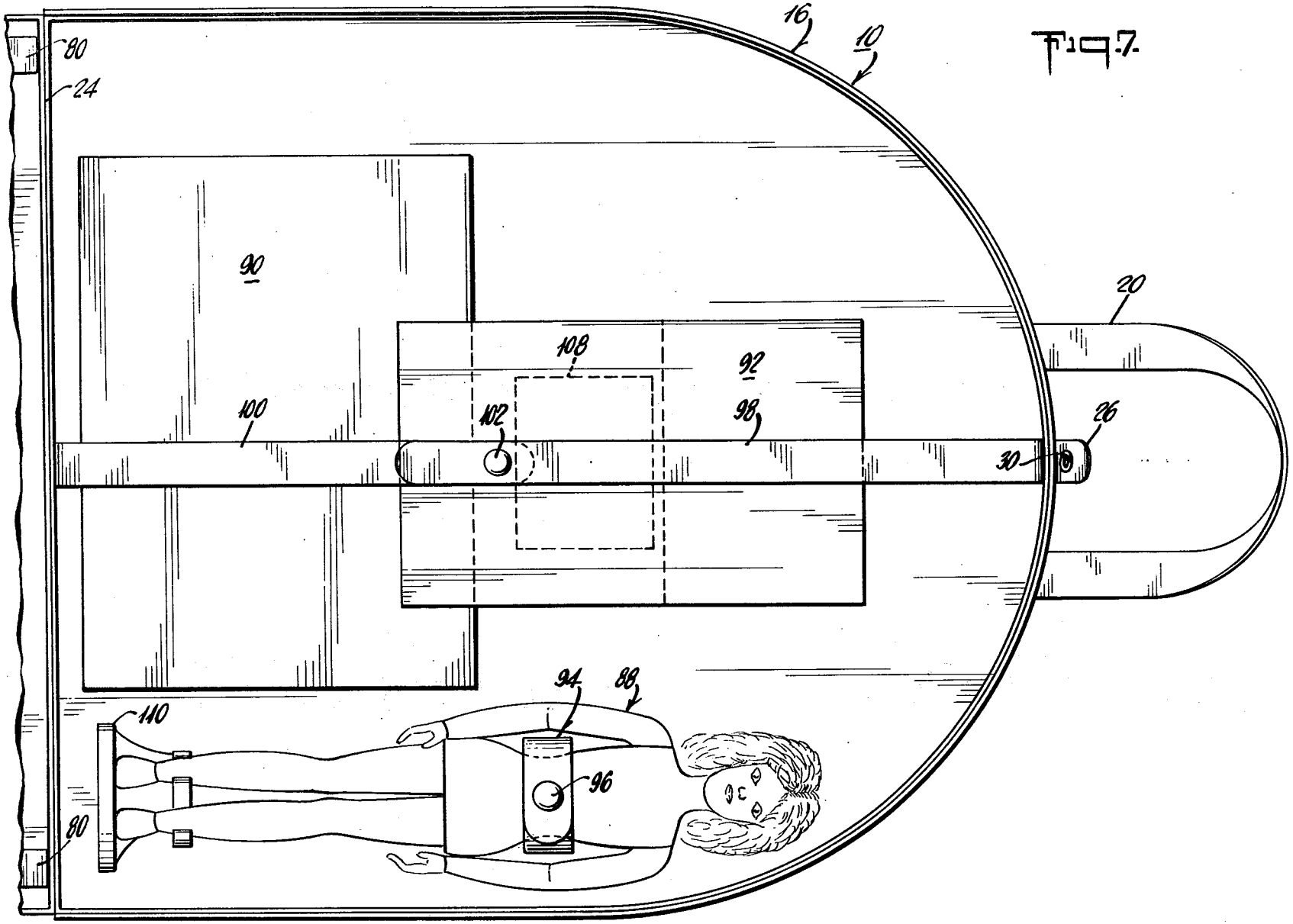
FIG. 7 is a plan view of the second compartment as seen in FIG. 2.

In FIGS. 5 and 6, there are shown cross-sectional views of the carrying case 12 in the closed condition. More particularly, attention is directed to the first compartment 14, which may have secured thereto a series of columns 34, which act to rigidify the first compartment and which are also part of the mechanism of the invention, as hereinafter described.

Also positioned within the compartment are two additional columns 36, 38, having blind bores located within the top and extending inwardly therefrom, the bores being designated by numerals 40, 42, for the purpose hereinafter appearing. Columns 44, 46 have located therein receptacles 48, 50, also for the purpose hereinafter appearing. Positioned at the uppermost surfaces of the various support columns 34, 36, 38, 44, 46, and formed integrally therewith, is a support platform 52. Located in the support platform are through bores 54 mating with blind bore 40; through bore 56 mating with blind bore 42; and receptacles 58, 60, mating with receptacles 48, 50.

It should be mentioned that the heights of all the columns are the same, so that the support platform is maintained in a single plane. The support platform and the various columns may be made of plastic, especially a plastic having a low coefficient of friction, and may be formed in a single molding operation. It is obvious that, without departing from the scope of the invention, the support platform may have substituted therefor a frame in which the means to support the turntable may be molded with the columns as a single unit, thus reducing the frictional engagement, but, of course, also reducing the support benefits. The support platform may also be formed separately and then affixed to the support columns by any convenient means, such as adhesive.

Positioned on top of the support platform 52 is the turntable 62. The turntable is generally circular in configuration, having a certain narrow width as best seen in FIGS. 5 and 6. The lower surface of the turntable may be made concave from the outer circumference with an increasing width again toward the center to reduce frictional engagement, but also reducing support benefits. It is also possible to provide a series of pintles on the upper surface of the platform upon which the turntable is supported. This also reduces the frictional engagement, but also reduces the support benefits. On the circumference of the turntable are a series of gears 64. These gears are wide, to enable them to be easily manufactured, and also to allow them to have sufficient torque with a low frictional engagement coefficient.

Adjacent the turntable 62 is a driver gear 66 having gear teeth 68 at its outer circumference. The driver gear has a downwardly extending locating post 70 passing through the hole 56 and into the receptacle 42 of the column 38. Positioned on the reverse side of the driver gear is a driver post 72. Gears 68, 64 mesh in the usual manner. By manually manipulating the post 72 so as to rotate the gear either in the clockwise or counterclockwise direction, the turntable is then rotated in the reverse direction, all in the well-known manner.

In a similar manner, the turntable has extending downwardly therefrom a locating post 74, passing through hole 54 and received in blind hole 40. With this in mind, it can readily be seen that the turntable remains in a stationary location during rotation. While the turntable and the gear are shown as being fairly thin in comparison with the rest of the construction, it is possible to vary the thickness, for example making the thickness of the turntable and the driver gear greater, which would tend to increase the driving effectiveness, while also increasing the frictional forces to be overcome.

Figure 4:
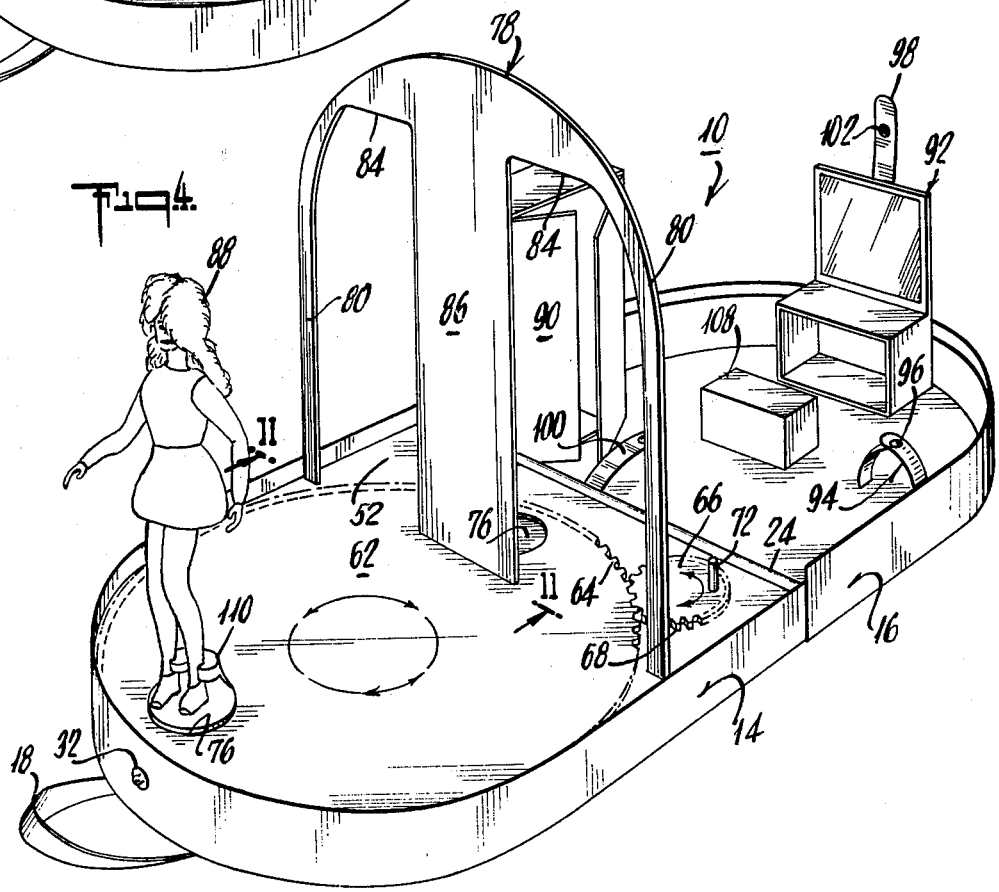
FIG. 4 is a view similar to FIG. 3, but showing the backdrop positioned across the rear of the first compartment and showing the doll positioned to securement means of the turntable.
Figure 8:
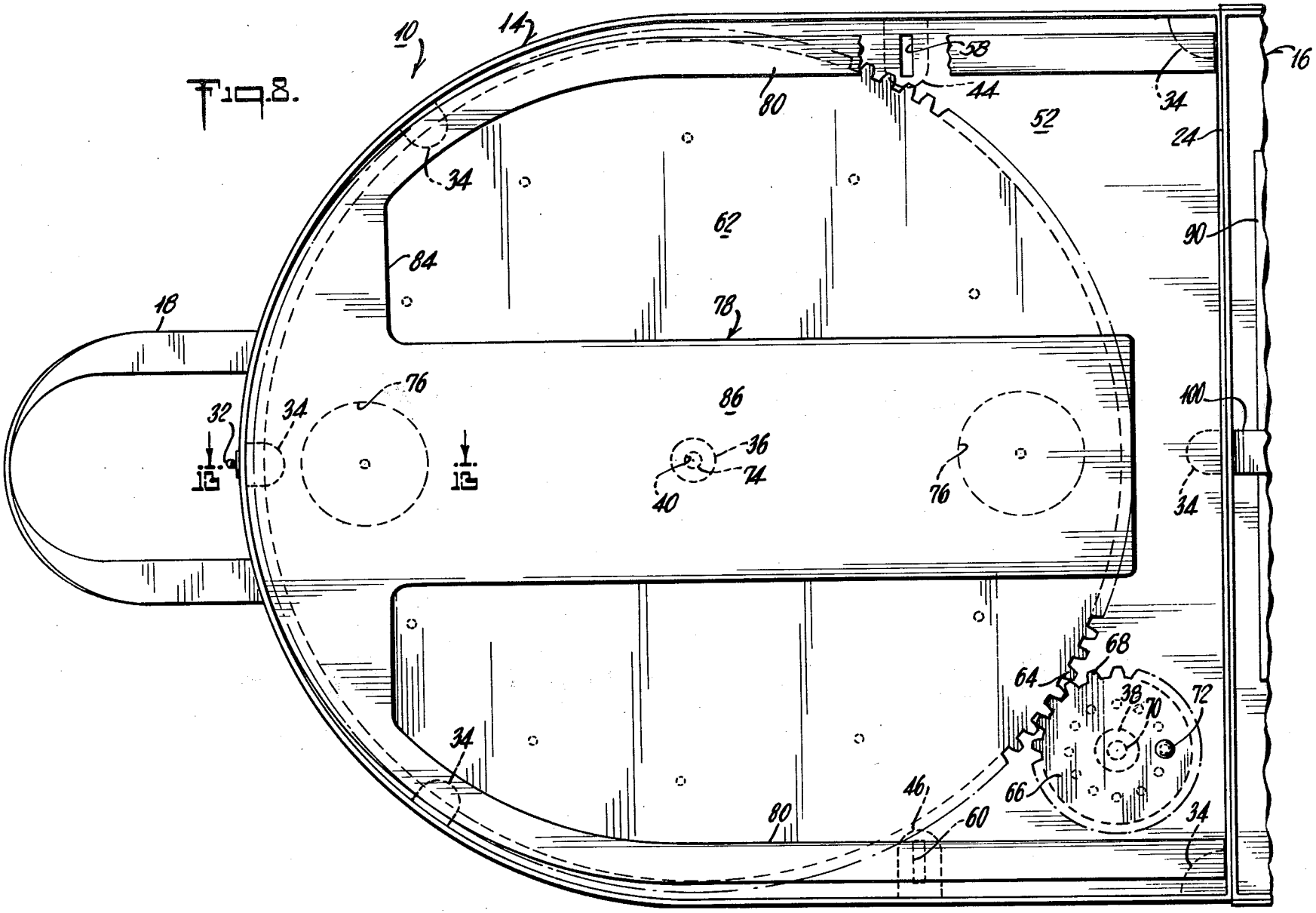
FIG. 8 is a plan view of the first compartment as seen in FIG. 2.

As best seen in FIGS. 4 and 8, there are located on the turntable two shallow circular recessions 76. The purpose of these recessions is to receive the support stand for the doll. It is obvious that in addition to using this mechanical means for mounting the support stand and the doll, it should also be possible to magnetize the support stand and place a magnet within the turntable, or, for example, to place two metal discs within the recessions and then mount a magnet in the support stand. It would also be possible to use a screw on the stand and to have a threaded opening in the turntable, or to provide the reverse construction. It can be seen that the method of mounting the support stand to the turntable may be varied and is not the essence of the invention.

As best seen in FIGS. 2 and 8, the backdrop 78 is normally stored in a knock-down condition against the turntable. The shape of the backdrop, especially at its upper level, very closely conforms to the shape of the carrying case. Obviously, this can be varied and is more a matter of aesthetic design. Of course, the height of the carrying case must be such that when the backdrop is placed into its position, with the legs 80 passing through the holes 58, 60 and into the receptacles 44, 66, sufficient clearance is provided up to the edges 84, so that a standard size fashion doll mounted on the turntable will pass underneath. The backdrop also has an opaque central portion 86 which obstructs the line of sight from the viewer to the rear portion of the turntable.

Figure 9:
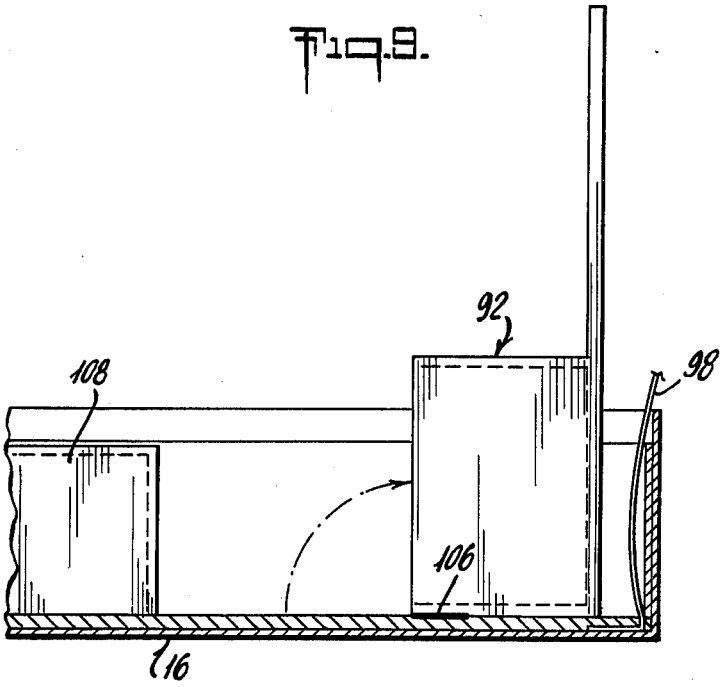
FIG. 9 is an enlarged cross-sectional fragmentary view taken along the lines 9—9 of FIG. 3.
Figure 10:
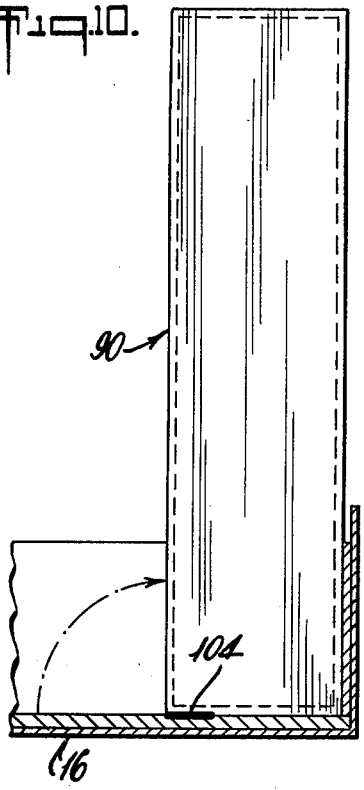
FIG. 10 is an enlarged fragmentary cross-sectional view taken along the lines 10—10 of FIG. 3.
Figure 11:
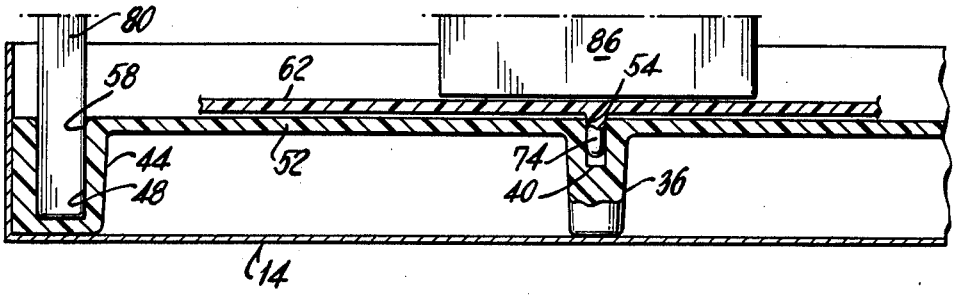
FIG. 11 is an enlarged fragmentary cross-sectional view taken along the lines 11—11 of FIG. 4.
Figure 12:
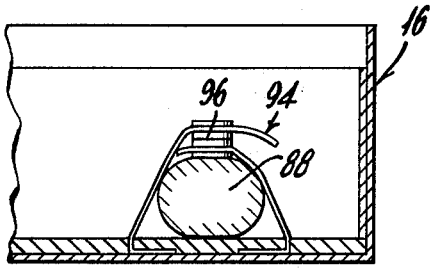
FIG. 12 is an enlarged fragmentary cross-sectional view taken along the lines 12—12 of FIG. 2.
Figure 13:
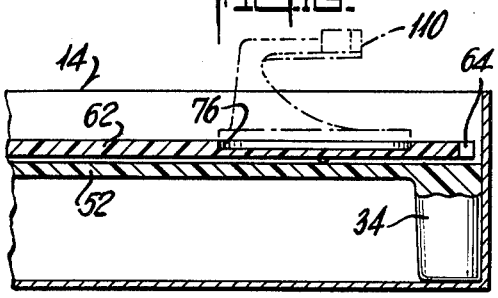
FIG. 13 is an enlarged fragmentary cross-sectional view taken along the lines 13—13 of FIG. 8, and showing the pedestal, in phantom, in position within the embodiment of a securement means.

Turning attention to the second compartment 16 of the carrying case 12, and particularly to FIGS. 2, 5–7, there is shown a storage compartment in which may be positioned a fashion doll 88 and pop-up furniture, such as a closet 90, and a dresser 92. Best seen in FIG. 12, the doll 88 is maintained in stored position by means of a strap 94 and standard male-female fasteners 96. As best seen in FIGS. 2, and 5 and 6, the two pieces of furniture 90, 92, are pivoted to the base of the second compartment 16, or it may also be referred to as one of the side walls of the carrying case, and are retained in position by straps 98, 100, which may be releasably secured to each other by standard male-female snap fasteners 102. As best seen in FIGS. 9 and 10, the closet 90 (FIG. 10) has a standard hinge 104 at its forward edge, and the dresser 92 has a standard hinge 106 at its forward edge. These hinges allow the furniture pieces to be pivoted upwardly to their usable conditions. Upon being pivoted upwardly, the dresser 92 exposes a seat 108.

Normally, the toy display mechanism is in storage position, as best illustrated in FIG. 1. In this condition the toy may be carried to any desired location, and it also may be stored away when not in use. When the user decides to play with the toy and perhaps make a fashion show for several friends, the snap fasteners 30, 32 are released so that the toy may be placed in a flat open condition, as best illustrated in FIG. 2.

The doll 88 is then released from the straps 94, and placed in an upright condition on the pedestal 110. Next the straps 98, 100 are released, allowing the closet 90 and the dresser 92 to be moved to an upright position. This is best illustrated in FIG. 3.

Figure 3:
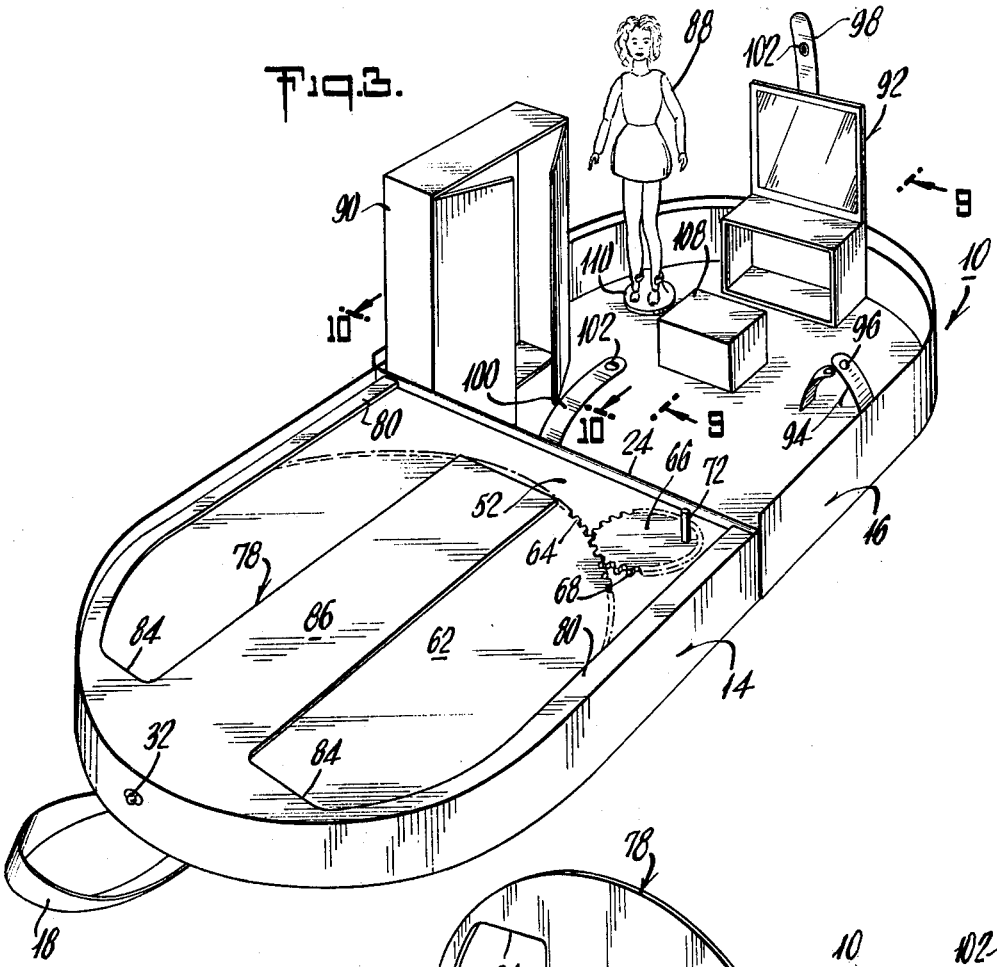
FIG. 3 is similar to FIG. 2, but showing the doll and the furniture of the second compartment in upright condition.

Then the backdrop 78 is moved from its storage condition as shown in FIGS. 2 and 3, and the lowermost portions of the arms 80 are slipped into the receptacles 44, 46, passing through the support platform 52 at openings 58, 60. The toy then is in its assembled condition as best illustrated in FIG. 4. The doll is placed in one of the receptacles 76 receiving the pedestal 110, and it is positioned also as shown in FIG. 4. When it is desired to move the doll, the post 72 is manually manipulated to turn the driver gear 66. The gears 68 mesh with the gears 64 of the turntable 62, causing it to rotate. The doll on the pedestal within the receptacle 76 then moves in circular movement, following the turntable, until it is rotated through the openings in the backdrop and behind the opaque portion 86 of the backdrop. There the clothes of the doll may be removed and a different set of clothes may be taken from the closet and other utilities may be taken from the storage space within the dresser. If it is desired to enhance the play, the doll may be seated on the seat 108, and the child may pretend that the doll is dressing herself and is properly preparing herself for the next display of fashions. As with any toy, it is obvious that many different types of structure may be utilized to achieve the results of the invention. For example, the gear teeth may be very wide, to allow them to be easily manufactured, and yet to provide the torque to drive the turntable. Furthermore, as previously mentioned, the support platform itself may be varied by eliminating much of the horizontal support. Furthermore, the support for the support platform may be varied, and for example, there may be a cardboard reinforcement proximate the exterior of the box, with perhaps reinforcing beams at appropriate locations. On the other hand, it is also possible to mold the support platform and the supporting structure as a single molded base piece.

While there has been described and illustrated preferred embodiments of the present invention, it is apparent that numerous alterations, omissions and additions may be made without departing from the spirit thereof.

I claim:

1. A toy fashion display mechanism for presentation of a doll fashion show including a doll which comprises:

portable storage means having at least two compartments, a turntable, means to rotate said turntable including a series of wide gears located on the circumference of said turntable, a driver gear having a depending locating post, an upwardly extending driver post on said driver gear for manual manipulation and said driver gear meshing with said wide gears to rotate said turntable support means secured within the first of said compartments, said support means including rigid column means to rotatably support said turntable and said turntable rotation means, means on said turntable to support at least one doll for display purposes including a shallow circular recess, a support stand matable into said recess and means on said support stand for engaging said doll, a backdrop removably mounted on the first of said compartments partially obscuring a portion of the turntable area, the backdrop having openings to allow passage of the displayed doll to the obscured area, the second of said compartments having means to releasably secure at least one doll, said compartment also having means to store a selection of clothing.

2. The invention according to claim 1, the doll storage means including a closet and dresser, pivotally secured to the wall of said second compartment, means to secure said closet and dresser in a stored position, comprising straps with releasable snap fasteners at the ends thereof, means to store said doll, including straps with releasable snap fasteners at the ends thereof.

3. The invention according to claim 1, portable storage means including a carrying case having two pivotally connected compartments, with releasable closure means to maintain said compartments in closed position, as desired, and carrying means to effect transportation.

4. The invention according to claim 1 wherein the support means includes a platform integrally formed with supporting columns.

5. The invention according to claim 1 wherein the support means includes columns secured to the first compartment, a platform positioned on top of the compartments and secured thereto.

6. The invention according to claim 1 wherein the support means includes a skeletal platform secured to said first compartment.

* * * * *